US009635919B2

(12) United States Patent
Fiedler

(10) Patent No.: US 9,635,919 B2
(45) Date of Patent: May 2, 2017

(54) CLOSURE DEVICE

(75) Inventor: Joachim Fiedler, Hannover (DE)

(73) Assignee: Fidlock GmbH, Hannover (DE)

( * ) Notice: Subject to any disclaimer, the term of this patent is extended or adjusted under 35 U.S.C. 154(b) by 813 days.

(21) Appl. No.: 13/576,776

(22) PCT Filed: Feb. 2, 2011

(86) PCT No.: PCT/EP2011/051474

§ 371 (c)(1),
(2), (4) Date: Oct. 1, 2012

(87) PCT Pub. No.: WO2011/095514

PCT Pub. Date: Aug. 11, 2011

(65) Prior Publication Data

US 2013/0011179 A1 Jan. 10, 2013

(30) Foreign Application Priority Data

Feb. 4, 2010 (DE) ..... 10 2010 006 928

(51) Int. Cl.
*A45C 13/10* (2006.01)

(52) U.S. Cl.
CPC ..... *A45C 13/10* (2013.01); *Y10T 403/30* (2015.01)

(58) Field of Classification Search
CPC . A45C 13/10; A45C 13/1069; A45C 13/1084; A44B 11/25; A44B 11/2592; A44B 11/2596
See application file for complete search history.

(56) References Cited

U.S. PATENT DOCUMENTS 2,625,227 A * 1/1953 Laskowitz ..... 416/112
2,956,324 A * 10/1960 Klein ..... 24/323
3,765,062 A * 10/1973 Cruse ..... 24/587.12
3,979,801 A * 9/1976 Tareau ..... A41F 1/006 24/587.12
5,311,647 A * 5/1994 Levy ..... 24/303
5,367,891 A * 11/1994 Furuyama ..... 63/29.2
5,671,516 A * 9/1997 Sartori ..... 24/652
(Continued)

FOREIGN PATENT DOCUMENTS

WO 2008006354 A2 1/2008
WO 2008006356 A2 1/2008
(Continued)

*Primary Examiner* — Michael P Ferguson
(74) *Attorney, Agent, or Firm* — The Webber Law Firm

(57) ABSTRACT

A closure device for connecting two parts includes a first connecting module and a second connecting module. The first connecting module can be arranged on the second connecting module in a closing direction, is mechanically latched with the second connecting module by a latching means in a closed position, and is held at the second connecting module against the closing direction. The first connecting module can be released from the second connecting module by movement of the first connecting module in an opening direction. A form-fit element is arranged on one of the connecting modules, which is formed to engage a recess on the other one of the connecting modules after establishing the latching of the first connecting module with the second connecting module by moving the first connecting module relative to the second connecting module against the opening direction.

10 Claims, 5 Drawing Sheets

(56) References Cited

U.S. PATENT DOCUMENTS

| | | | | |
|---|---|---|---|---|
| 6,804,865 | B2 * | 10/2004 | Grunberger et al. | 24/303 |
| 6,857,169 | B2 * | 2/2005 | Chung | 24/303 |
| 7,999,736 | B2 | 8/2011 | Albrecht | |
| 8,001,662 | B1 * | 8/2011 | Guber | 24/319 |
| 2010/0283269 | A1 | 11/2010 | Fiedler | |
| 2010/0287741 | A1 | 11/2010 | Fiedler | |
| 2010/0308605 | A1 | 12/2010 | Fiedler | |
| 2010/0325844 | A1 | 12/2010 | Fiedler | |
| 2011/0131770 | A1 | 6/2011 | Fiedler | |
| 2011/0138583 | A1 | 6/2011 | Fiedler | |

FOREIGN PATENT DOCUMENTS

| | | | |
|---|---|---|---|
| WO | 2008006357 | A2 | 1/2008 |
| WO | 2009010049 | A2 | 1/2009 |
| WO | 2009012796 | A1 | 1/2009 |
| WO | 2009092368 | A2 | 7/2009 |
| WO | 2009103279 | A2 | 8/2009 |
| WO | 2010006594 | A2 | 1/2010 |

* cited by examiner (B-B)

(A-A)

(A-A)

(B-B)

(B–B)

(A–A)

(B-B)

(A - A)

(A-A)

(B-B)

CLOSURE DEVICE

CROSS-REFERENCE TO A RELATED APPLICATION

This application is a National Phase Patent Application of International Patent Application Number PCT/EP2011/051474, filed on Feb. 2, 2011, which claims priority of German Patent Application Number 10 2010 006 928.0, filed on Feb. 4, 2010.

BACKGROUND OF THE INVENTION

1) Field of the Invention

The invention relates to a closure device for connecting two parts.

2) Related Art

Such closure device includes a first connecting module and a second connecting module, which can be arranged on each other in a closing direction and are mechanically latched with each other in a closed position. By moving the first connecting module or a part of the first connecting module in an opening direction, which differs from the closing direction, the first connecting module can be released from the second connecting module, in order to open the closure device in this way.

In a closure device of this type known from WO 2008/006357 A2, two connecting modules are attached to each other in a vertical closing direction and thereby mechanically lock into place. Due to the fact that both on the first connecting module and on the second connecting module one magnet each or on the one hand a magnet and on the other hand a magnetic armature are arranged, establishing the mechanical latching and hence transferring the closure device into the closed position is supported magnetically. With suitable dimensions of the magnets, closing of the closure device largely is effected automatically, when the connecting modules are approached to each other. By shifting or rotating the first connecting module relative to the second connecting module, the mechanical latching can be released, wherein the magnetic means at the same time are sheared off from each other by a lateral movement and hence are removed from each other.

In their closed position, closure devices of this type on the one hand represent a safe and loadable connection of two parts with each other and on the other hand can easily be closed and be opened again in a haptically pleasant way. The fields of application of such closure devices extend to devices of a general kind for (releasably) connecting two parts, such as closures of bags, flaps or lids, connecting devices for belts or ropes or other components and the like.

In a closure device as it is known for example from WO 2008/006357 A2, the first connecting module is held at the second connecting module against the closing direction, when the first connecting module is disposed at the second connecting module in the closed position, in that the two connecting modules are mechanically latched with each other by a mechanical latching means. This mechanical latching means includes an elastically resilient spring locking element at one of the connecting modules, to which a latching protrusion at the other one of the connecting modules can be attached in the closing direction, so that the spring locking element is pushed aside transversely to the closing direction and in the manner of a clip element mechanically gets in engagement with the latching protrusion and thereby a mechanical latching acting against the closing direction is established. In the closed position, a secure hold of the two connecting modules at each other is provided by this mechanical latching.

However, there exists a need for a further improvement of such closure device, in order to increase the loadability of such closure device under a great tensile load of the closure device with load forces acting against the closing direction.

An approach for increasing the mechanical loadability can consist in designing the mechanical latching means more stably with a latching protrusion and a spring locking element. However, this leads to the fact that establishing the latching by attaching the first connecting module to the second connecting module in the closing direction becomes more difficult, because a larger force is required for establishing the latching. In addition, the overall size is increased and magnetic means (when they should be provided for supporting the establishment of the mechanical latching) become more expensive, because the magnetic means also must be dimensioned larger for an effective closing support for providing a stronger force of magnetic attraction.

SUMMARY OF THE INVENTION

It is the object underlying the present invention to provide, a closure device which is particularly strongly loadable against the closing direction, in which transferring the connecting modules into the closed position is not made substantially more difficult.

According to an exemplary embodiment of the invention, a closure device as mentioned above includes a form-fit element arranged on one of the connecting modules, which is formed to get in engagement with a recess on the other one of the connecting modules after establishing the latching of the first connecting module with the second connecting module by moving the first connecting module relative to the second connecting module against the opening direction, in order to hold the first connecting module in the closed position on the second connecting module against the closing direction in addition to the mechanical latching means.

The form-fit element preferably is formed to establish a form fit between the connecting modules against the closing direction by engaging into the recess.

The protrusion engaging into the recess in the closed position, in addition to the latching means, establishes a positive connection between the connecting modules, which in the manner of an undercut holds the first connecting module at the second connecting module. The form-fit element for example can be formed in the manner of a trunnion which, by moving the first connecting module relative to the second connecting module against the opening direction is pushed into the recess and thus establishes a positive connection against the closing direction.

Because the protrusion is brought in engagement with the recess by a movement against the opening direction, neither portions of the protrusion nor of the recess accommodating the protrusion must be formed elastic. For bringing the protrusion in engagement with the recess, no parts must be pushed aside elastically. This provides for forming the trunnion as strong as desired, without thereby substantially complicating the latching and the transfer of the two connecting modules into the closed position.

For closing the closure device, the connecting module advantageously must be attached to the second connecting module offset by an offset in the opening direction, in order to then move the first connecting module against the opening direction by the offset for bringing the form-fit element in engagement with the associated recess. In other words, the connection of the two connecting modules is not established by simply attaching the first connecting module to the second connecting module in the closing direction, but first of all the first connecting module must be attached to the second connecting module in the closing direction, until the latching means latchingly gets in engagement, in order to then shift the first connecting module by the offset against the opening direction relative to the second connecting module for the final transfer into the closed position.

In a concrete configuration, the latching means can be formed by at least one plug-in portion arranged on one of the connecting modules and at least one spring locking element arranged on the other one of the connecting modules, wherein the plug-in portion and the spring locking element each include at least one latching protrusion for establishing a mechanical latching acting against the closing direction. The plug-in portion can be formed largely rigid, whereas the spring locking element is formed elastically resilient in a direction transverse to the closing direction, so that for attaching the first connecting module to the second connecting module the plug-in portion can be attached to the spring locking element, the latching protrusions thereby run up onto each other and the spring locking element thus is pushed aside transversely to the closing direction, until the latching protrusions of the plug-in portion and of the spring locking element latchingly snap in engagement with each other in a positive manner.

In an advantageous aspect, each connecting module can include a plug-in portion and at least one spring locking element. This provides for forming the connecting modules identical in construction, where for closing the closure device the plug-in portion of the first connecting module gets in engagement with the spring locking element of the second connecting module and at the same time the plug-in portion of the second connecting module gets in engagement with the spring locking element of the first connecting module.

In this connection, each connecting module also can include a form-fit element and a recess associated to the form-fit element of the other connecting module. In other words, each connecting module includes a form-fit element and a recess, wherein after latching by the latching means and moving the connecting modules relative to each other against the opening direction, the protrusion of the first connecting module gets in engagement with the recess of the second connecting module and the protrusion of the second connecting module gets in engagement with the recess of the first connecting module. In this way, a particularly strong, also symmetrical additional positive connection is provided against the closing direction, which ensures a high mechanical loadability of the closure device even against large load forces.

The closure device fundamentally can be designed purely mechanically without magnetic means. Closing then is effected by manually attaching the first connecting module to the second connecting module and manually pressing the latching means in engagement.

In an advantageous aspect, the closure device can include magnetic means which for supporting the transfer of the first connecting module into the closed position produce a force of magnetic attraction between the first connecting module and the second connecting module. These magnetic means for example can be formed by magnets arranged on the connecting modules or by a magnet arranged on the one connecting module and a magnetic armature arranged on the other connecting module. The magnetic means can be formed such that they produce such a force of magnetic attraction between the first connecting module and the second connecting module that when attaching the first connecting module to the second connecting module the mechanical latching is established largely automatically via the latching means, so that when being attached to the second connecting module, the first connecting module is latched automatically in a manner pleasant for a user.

In addition, the magnetic means can be formed such that they magnetically support moving the first connecting module relative to the second connecting module against the opening direction for bringing the form-fit element in engagement with the associated recess. For this purpose, for example, a magnet on the first connecting module can be arranged relative to a magnet on the second connecting module such that in the closed position with the latching means latched and with the protrusion in engagement with the recess, the same frontally oppose each other with oppositely polarized magnetic poles. When the first connecting module is arranged on the second connecting module with the offset, the magnetic means with the latching means latched produce a force of magnetic attraction transverse to the closing direction against the opening direction which moves the first connecting module to the second connecting module against the opening direction and brings the protrusion in engagement with the recess.

The opening direction differs from the closing direction. This means that the opening direction is directed vertical or at an oblique angle to the closing direction, but not parallel to the closing direction and not antiparallel either, i.e. opposite to the closing direction.

The opening direction for example can be directed vertical to the closing direction. The opening direction here is defined by the latching protrusions of the latching means, which for example extend transverse to the closing direction. The opening direction is directed tangentially to these latching protrusions and defines the direction along which the plug-in portion of the one connecting module tangentially can be pushed out of engagement with the spring locking elements of the other connecting module.

In an advantageous aspect, a main loading direction, along which tensile forces act on the closure device, is directed at a first oblique angle to the closing direction and at a second oblique angle to the opening direction.

The second oblique angle preferably corresponds to an obtuse angle greater than 90° and smaller than 180°. If the main loading direction is directed at an angle greater than 90° to the opening direction, this results in the fact that a vector component of the main loading direction is directed against the opening direction. This in turn leads to the fact that opening of the closure device under load at least becomes difficult, because for this purpose a movement against the load forces is required, in order to move the first connecting module relative to the second connecting module in the opening direction. In addition, this leads to the fact that loading of the closure device has the effect that the engagement of the protrusion with the recess for establishing the additional positive connection is made completely and also amplified under load (when it has not yet been made completely), because due to the load the connecting modules are loaded against the opening direction and hence relative to each other such that the protrusion is pressed into the recess. Under load, the connection between the connecting modules thus is even amplified.

In addition, a locking means can be provided for securing the engagement of the protrusion with the recess. The locking means locks the first connecting module with respect to the second connecting module against shifting in the opening direction as soon as the protrusion has come in engagement with the recess, and in this way prevents an inadvertent release of the closure device by moving the connection modules to each other in the opening direction. Only by actuating the locking means can the first connecting module then be shifted relative to the second connecting module in the opening direction and the closure device hence can be opened.

BRIEF DESCRIPTION OF THE DRAWINGS

The idea underlying the invention will be explained in detail below with reference to the exemplary embodiments illustrated in the Figures:

FIGS. 1 to 5 (each with views A to D) show an exemplary embodiment of a closure device with a first connecting module 1 and a second connecting module 2 in different phases of movement, namely before closing (FIGS. 1A to 1D), during closing (FIGS. 2A to 2D and FIGS. 3A to 3D), in a closed position (FIGS. 4A to 4D), and during opening (FIGS. 5A to 5D).

Figure 1A:
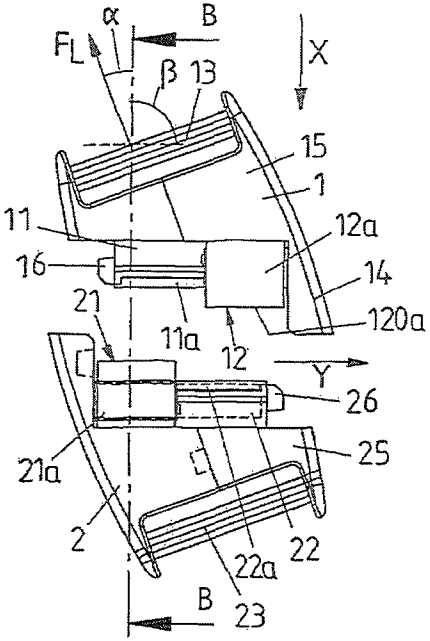
FIG. 1A shows a front view of a closure device with a first connecting module and a second connecting module in the open condition.
Figure 1B:
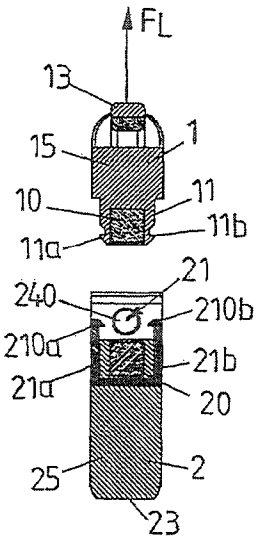
FIG. 1B shows a sectional view of the arrangement along line B-B of FIG. 1A.
Figure 1C:
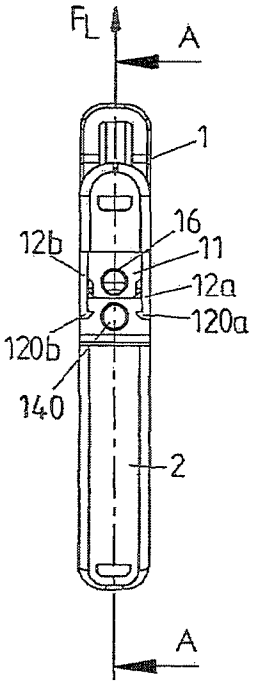
FIG. 1C shows a side view of the arrangement of FIG. 1A.
Figure 1D:
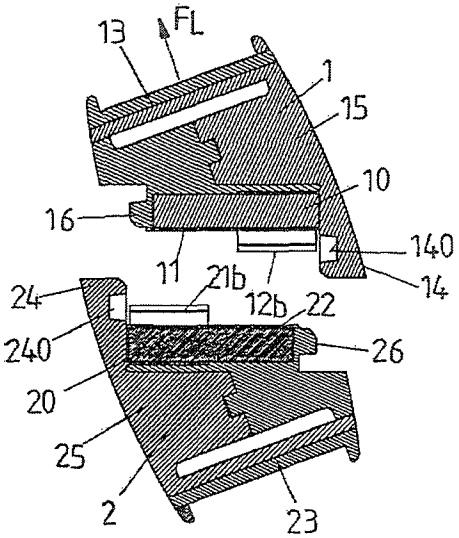
FIG. 1D shows a sectional view of the arrangement along line A-A of FIG. 1C.

The views in FIGS. 1A to 1D, 2A to 2D, 3A to 3D, 4A to 4D, 5A to 5D are chosen such that view A shows a front view, view B a sectional view in a sectional plane transverse to the drawing plane of view A, view C a side view and view D a sectional view in a sectional plane transverse to the drawing plane of view C.

The closure device is formed by a first connecting module 1 and a second connecting module 2, which each can be connected with a belt or rope via a belt stay 13, 23. The closure device then serves for connecting two belts or two other components, which preferably can effect a tensile load acting on the closure device in a main loading direction FL.

FIGS. 1A to 1D first show the closure device in an open condition. In this condition, the connecting modules 1, 2 are present separate from each other, so that the belts or other components connected with the connecting modules 1, 2 are released from each other.

The connecting modules 1, 2 substantially are formed identical in construction. The connecting modules 1, 2 each include a plug-in portion 11, 22 and two spring locking elements 12*a*, 12*b*, 21*a*, 21*b*, which together form a latching means for mechanically latching the connecting modules with each other. The plug-in portions 11, 22 and the spring locking elements 12*a*, 12*b*, 21*a*, 21*b* each include latching protrusions 11*a*, 11*b*, 120*a*, 120*b*, 210*a*, 210*b*, 22*a*, 22*b*, which are formed to establish a latching, positive connection between the connecting modules 1, 2 against a closing direction X. In one aspect, each plug-in portion 11, 22 may include two opposing faces each defining a latching recess. In another aspect, each spring locking element 12*a*, 12*b*, 21*a*, 21*b* may include two opposing arms each having an inwardly extending latching protrusion.

For closing the closure device, as shown in FIGS. 2A to 2D, the connecting modules 1, 2 can be attached to each other in the closing direction X. By attaching the connecting modules 1, 2 to each other in the closing direction X, the plug-in portion 11 with its latching protrusions 11*a*, 11*b* is attached to the latching protrusions 210*a*, 210*b* of the at least partly elastically resilient spring locking elements 21*a*, 21*b*, so that the latching protrusions 11*a*, 11*b*, 210*a*, 210*b* run up onto each other, the spring locking elements 21*a*, 21*b* are pushed aside to the outside transversely to the closing direction X, and the plug-in portion 11 with its latching protrusions 11*a*, 11*b* latchingly snaps in engagement with the spring locking elements 21*a*, 21*b* with the latching protrusions 210*a*, 210*b* arranged thereon. At the same time, the latching protrusions 22*a*, 22*b* of the plug-in portion 22 of the second connecting module 2 also run up onto the latching protrusions 120*a*, 120*b* of the spring locking elements 12*a*, 12*b* of the first connecting module, so that the same also latchingly snap in engagement with each other. This latched condition is shown in FIGS. 3A to 3D.

As can be taken from FIGS. 2A to 2D and FIGS. 3A to 3D, the connecting modules 1, 2 first must be attached to each other by an offset A against an opening direction Y directed vertical to the closing direction X (see FIGS. 2D and 3D) with respect to their final closed position. This is due to the fact that on the end face of the plug-in portion 11 of the first connecting module 1 and also on the end face of the plug-in portion 22 of the second connecting module 2 a protrusion 16, 26 each is formed, which axially protrudes from the respective plug-in portion 11, 22 along the opening direction Y and is associated to a recess 240 or 140 at the respective other connecting module 2 or 1.

These protrusions 16, 26 serve to provide an additional positive connection between the connecting modules 1, 2 against the closing direction X by an engagement into the respectively associated recess 240 or 140 in a final closed position, so that the closure device can withstand particularly high load forces in the main loading direction FL.

After, as shown in FIGS. 3A to 3D, the connecting modules 1, 2 have been attached to each other in the closing direction X and the latching means (formed by the plug-in portions 11, 22 and the spring locking elements 12*a*, 12*b*, 21*e*, 21*b*) is locked into place, the first connecting module 1 additionally must be moved relative to the second connecting module 2 by the offset A against the opening direction Y, in order to transfer the closure device into its final closed position, as it is shown in FIGS. 4A to 4D.

In the closed position as shown in FIGS. 4A to 4D, the closure device then is connected with the spring locking elements 12*a*, 12*b*, 21*a*, 21*b* by the mechanical latching of the plug-in portions 11, 22 on the one hand and by the engagement of the protrusions 16, 26 into the associated recesses 140, 240 is safely and mechanically highly loadably connected with each other against the closing direction X and also against the main loading direction FL.

On the connecting modules 1, 2 magnetic means 10, 20 are provided, which for example can be formed by one magnet 10, 20 each or by a magnet on the one hand and a magnetic armature in the form of a core made of a ferromagnetic material on the other hand. These magnetic means 10, 20 serve to magnetically support the transfer of the connecting modules 1, 2 into the closed position as shown in FIGS. 4A to 4D and advantageously can be dimensioned such that when attaching the connecting modules 1, 2 to each other, the mechanical latching of the plug-in portions 11, 22 with the spring locking elements 12*a*, 12*b*, 21*a*, 21*b* can be effected automatically or largely automatically, and thus a user need not mechanically press the connecting modules 1, 2 in engagement with each other with much effort.

Figure 2D:
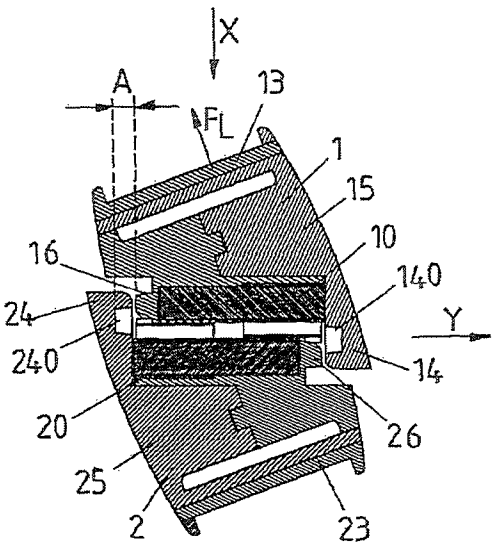
FIG. 2D shows a sectional view of the arrangement along line A-A of FIG. 2C.
Figure 2C:
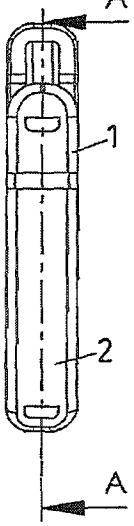
FIG. 2C shows a side view of the arrangement of FIG. 2A.
Figure 2B:
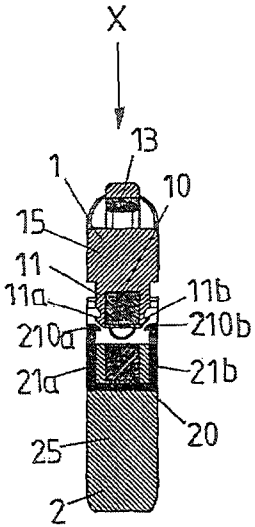
FIG. 2B shows a sectional view of the arrangement along line B-B of FIG. 2A.
Figure 2A:
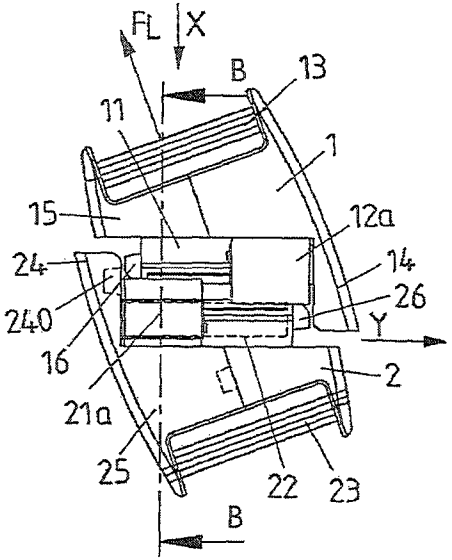
FIG. 2A shows a front view of the closure device on closing in a condition before a latching means of the closure device has come in engagement.
Figure 3A:
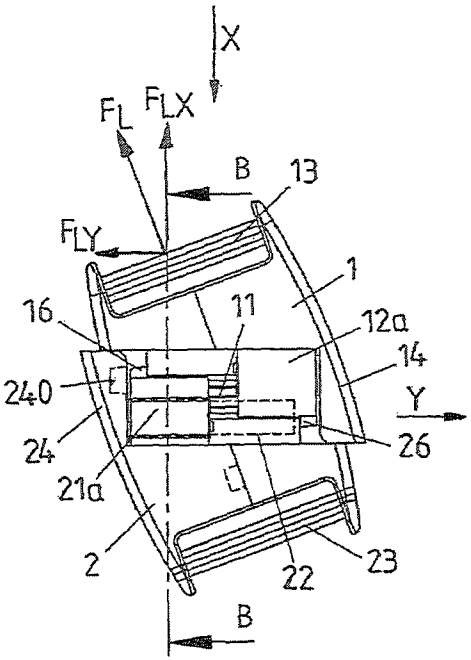
FIG. 3A shows a front view of the closure device with connecting modules attached to each other in a closing direction.
Figure 3B:
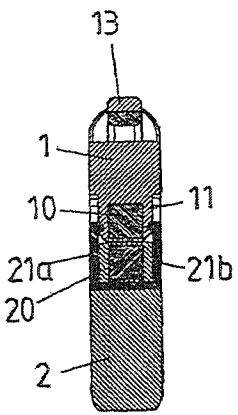
FIG. 3B shows a sectional view of the arrangement along line B-B of FIG. 3A.
Figure 3C:
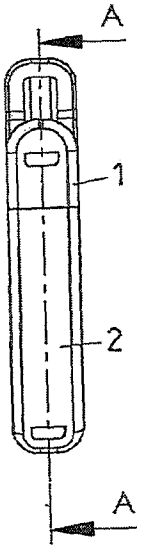
FIG. 3C shows a side view of the arrangement of FIG. 3A.
Figure 3D:
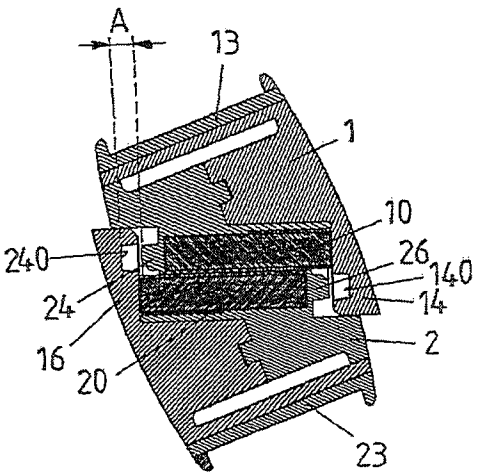
FIG. 3D shows a sectional view of the arrangement along line A-A of FIG. 3C.

The magnetic means 10, 20 are arranged at the connecting modules 1, 2 such that only in the closed position as shown in FIGS. 4A to 4D they largely frontally oppose each other in an attracting manner. If the connecting modules 1, 2, as shown in FIGS. 2D and 3D, are attached to each other with an offset A in the closing direction X, the magnetic means 10, on the other hand are offset to each other in the opening direction Y, so that they exert a force of magnetic attraction against the opening direction Y between the connecting modules 1, 2, and hence automatically pull the connecting modules 1, 2 into the closed position against the opening direction Y and bring the protrusions 16, 26 in engagement with the associated recesses 240 and 140, respectively.

Figure 4A:
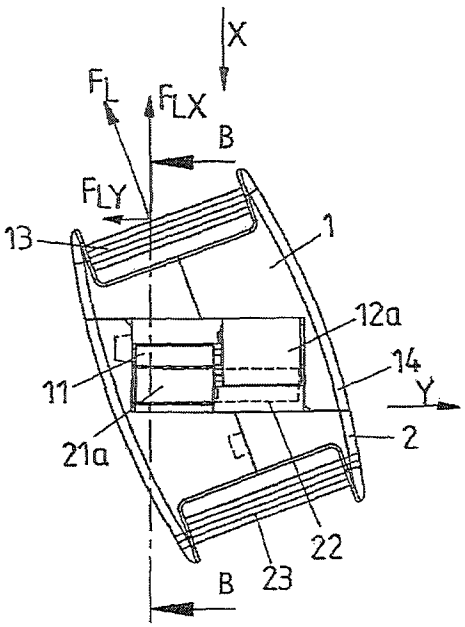
FIG. 4A shows a front view of the closure device in a closed position.
Figure 4B:
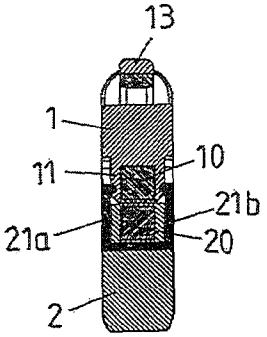
FIG. 4B shows a sectional view of the arrangement along line B-B of FIG. 4A.
Figure 4C:
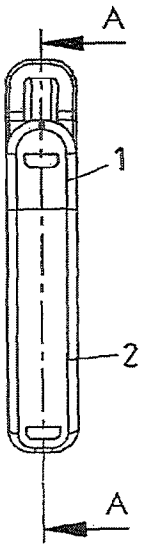
FIG. 4C shows a side view of the arrangement of FIG. 4A.
Figure 4D:
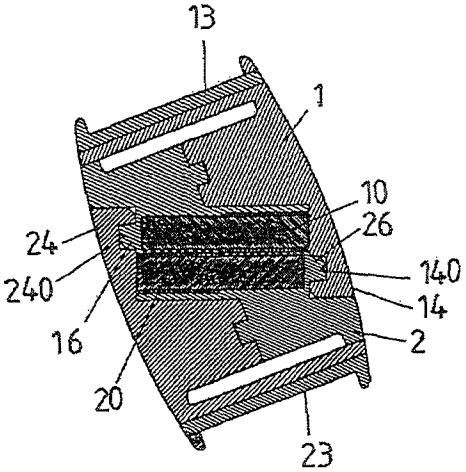
FIG. 4D shows a sectional view of the arrangement along line A-A of FIG. 4C.
Figure 5D:
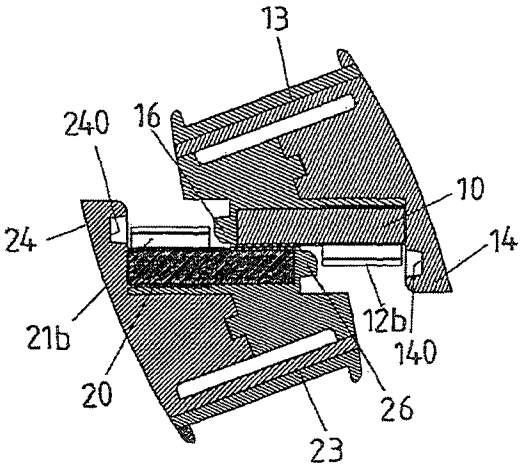
FIG. 5D shows a sectional view of the arrangement along line. A-A of FIG. 5C.
Figure 5C:
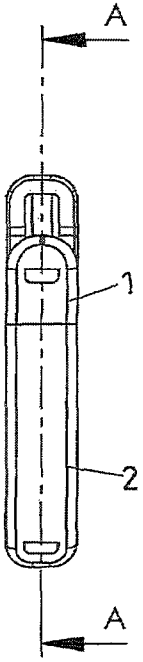
FIG. 5C shows a side view of the arrangement of FIG. 5A.
Figure 5B:
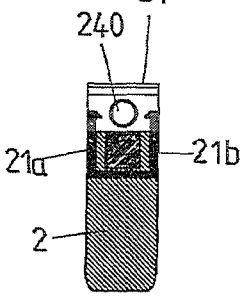
FIG. 5B shows a sectional view of the arrangement along line B-B of FIG. 5A.
Figure 5A:
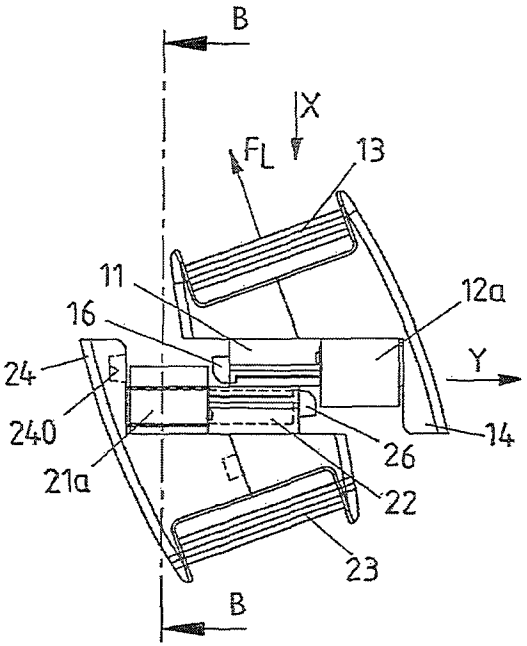
FIG. 5A shows a front view of the closure device on opening.

As shown in FIG. 4D, the magnetic means 10, 20 can at least slightly be offset to each other in the opening direction Y also in the closed position, so that in the closed position the connecting modules 1, 2 also are biased to each other against the opening direction Y due to the slight offset of the magnetic means 10, 20 and thus the protrusions 16, 26 are safely pressed into the recesses 240 and 140, respectively.

As shown in FIG. 4A, the main loading direction FL is directed obliquely to the closing direction X and also obliquely to the opening direction Y. With a direction vector component FLX the main loading direction FL is directed against the closing direction X, and with a direction vector component FLY it is directed against the opening direction Y.

In this connection, one direction vector component is understood to be a vector component of the main loading direction FL upon projection onto the closing direction X or the opening direction Y. The direction vector component FLX against the closing direction X is the vector component of the main loading direction L upon projection onto the axis of the closing direction. The direction vector component FLY against the opening direction is the projection of the main loading direction FL onto the axis of the opening direction Y.

Due to the fact that the main loading direction FL is directed at an obtuse angle (greater than 90°, but smaller than 180°) to the opening direction Y and this results in a direction vector component FLY of the main loading direction FL, which is directed against the opening direction Y, several advantageous effects are obtained.

Firstly, by exerting a tensile load on the closure device in the main loading direction FL, the engagement of the protrusions 16, 26 with the recesses 240, 140 is amplified, as due to a load acting in the main loading direction FL the connecting modules 1, 2 are loaded against the opening direction Y (via the direction vector component FLY).

Secondly, when applying a load, the transfer of the closure device into the final closed position also is supported in that the connecting modules 1, 2 are moved towards each other against the opening direction Y, when the closure device has not yet or not yet completely been transferred from the condition as shown in FIGS. 3A to 3D into the final closed position as shown in FIGS. 4A to 4D.

Thirdly, the oblique orientation of the opening direction Y at an obtuse angle to the main loading direction FL effects that under load the closure device cannot be opened or can at least only be opened with great difficulty.

For opening, the first connecting module 1, as shown in FIGS. 5A to 5D, must be moved in the opening direction Y relative to the second connecting module 2, in order to tangentially push the plug-in portions 11, 22 with the latching protrusions 11*a*, 11*b*, 22*a*, 22*b* arranged thereon in the opening direction Y out of engagement with the latching protrusions 120*a*, 120*b*, 210*a*, 210*b* of the spring locking elements 12*a*, 12*b*, 21*a*, 21*b*. Due to this movement in the opening direction Y, the protrusions 16, 26 also get out of engagement with the recesses 240, 140, so that the connecting modules 1, 2 can be released from each other, when the plug-in portions 11, 22 are out of engagement with the spring locking elements 12*a*, 12*b*, 21*a*, 21*b*, as shown in FIGS. 5A to 5D.

If no load is applied to the closure device in the main loading direction FL, opening can be effected in a haptically pleasant way, since the tangential movement of the magnetic means 10, 20 in the opening direction Y can be effected without much expenditure of force.

The protrusions 16, 26 at the plug-in portions 11, 22 are formed like trunnions and axially protrude from the plug-in portions 11, 22. The protrusions 16, 26, which for example can be shaped like circular-cylindrical trunnions, can be formed with any stability, wherein the stability substantially is dependent on the geometry and the material properties of the protrusions 16, 26 and of the recesses 140, 240 accommodating the protrusions 16, 26.

The protrusions 16, 26 and a housing tab 14, 24 (also referred to as a protrusion element) protruding from a base body 15, 25 of each connecting module 1, 2 and forming the recess 140, 240 can be fabricated of a metal, in order to ensure a safe, positive engagement. Other parts of the connecting modules 1, 2 for example can be made of plastics as molded plastic parts.

The magnetic means 10, 20 are not necessarily formed and dimensioned such that they automatically pull the connecting modules 1, 2 against the opening direction Y into the final closed position as shown in FIGS. 4A to 4D. It can also be provided that the magnetic means 10, 20 merely magnetically support the attachment in the closing direction, whereas shifting the connecting modules 1, 2 relative to each other against the opening direction Y must be effected manually.

Alternatively or in addition it can also be provided that the shifting movement by the offset A against the opening direction Y is resiliently supported by additional mechanical springs.

To additionally secure the engagement of the protrusions 16, 26 into the recesses 140, 240, a locking means can be provided, which locks the first connecting module 1 with respect to the second connecting module 2 against shifting into the opening direction Y, as soon as the protrusions 16, 26 have come in engagement with the recesses 140, 240. Hence, an additional safeguard is realized, which prevents an inadvertent opening of the closure device by shifting the connecting modules 1, 2 relative to each other in the opening direction Y. The closure device then can only be shifted in the opening direction Y and hence be opened by an additional operation, namely by releasing the locking means.

Such locking for example can be realized in that the spring locking elements 12*a*, 12*b*, 21*a*, 21*b* still are under pre-tension, when they have been attached to the plug-in portions 11, 22 in the condition shown in FIGS. 3A to 3D. They can be designed such that they only snap into their final latching position and in the same for example engage in associated recesses in the plug-in portions 11, 22, when the final closed position as shown in FIGS. 4A to 4D has been reached. For opening the closure device, the spring locking elements 12*a*, 12*b*, 21*a*, 21*b* then must be released out of their engagement by active actuation, so as to be able to move the connecting modules 1, 2 relative to each other in the opening direction Y.

The main loading direction FL need not necessarily be directed obliquely to the closing direction X. It is also conceivable that the main loading direction is directed antiparallel to the closing direction X, i.e. exactly opposite to the closing direction X.

In addition, magnetic means need not necessarily be provided. The closure device also can be designed purely mechanically, without magnetic means of the type described here being present.

The idea underlying the invention is not limited to the exemplary embodiments described above, but can also be realized in other embodiments of closure devices, as they are known for example from WO 2008/006357 A2, WO 2009/092368 A2, WO 2010/006594 A2, WO 2008/006354 A2, WO 2008/006356 A2, WO 2009/010049 A2 and WO 2009/12796 A2, whose contents are to be included in the present application.

In the closure devices known from these documents, transferring the closure parts into a closed position is effected in a magnetically supported way, so that in a closed position the same are mechanically latched with each other. Magnetic means need, however, not necessarily be provided in these closure devices either. The closure devices also can be designed purely mechanically, without magnetic means being present.

A closure device of the type described is suitable and advantageously usable for a multitude of different uses. The closure device can be employed as closure for bags, rucksacks, suitcases, furniture or other storage or transport means or containers. The closure device also can be used for the releasable connection of components or flexible pulling means such as ropes or straps (e.g. for mountaineering equipment or sailing equipment or also for dog collars, tow ropes or other ropes or cables), for fastening motorcycle or bicycle accessories to a motorcycle or bicycle (such as for fastening saddle bags or other sacks or bags, of tools or the like) or for infant carriers, perambulators or baby carrying frames. In addition, the closure device can be used for fastening mobile phones, weapons, truncheons or other utensils (e.g. for the police) to a holster.

This list is by no means limiting. In principle, a use of a closure device as described above is possible and advantageous wherever an easily closing closure is desired, which at the same time however is safely closed and loadable in the closed condition.

The invention claimed is:

1. A closure device for connecting two parts, comprising a first connecting module and a second connecting module, wherein:

each of the first and second connecting modules comprises a base body having opposing front and rear faces, opposing proximal and distal side surfaces defining an X direction extending therebetween, and opposing first and second side surfaces defining an Y direction extending therebetween, the Y direction being directed perpendicular or at an oblique angle with respect to the X direction;

the first connecting module is constituted to be arranged on the second connecting module in the X direction, wherein at least one of the first connecting module and the second connecting module comprises a plug-in portion extending along the distal side surface thereof, having two opposing front and rear faces each defining a latching recess longitudinally extending in the Y direction, and the other of the at least one of the first connecting module and the second connecting module comprises a corresponding spring locking element extending along the distal side surface thereof, having two opposing elastically resilient arms each having an inwardly extending latching protrusion longitudinally extending in the Y direction, the plug-in portion and the spring locking element together forming a mating latching arrangement, wherein the plug-in portion acts onto the spring locking element when arranging the first connecting module on the second connecting module for elastically deflecting the arms of the spring locking element in a Z direction transverse to the X and Y directions until the latching recesses and the latching protrusions snap into engagement with each other such that, in a closed position, the first connecting module is mechanically locked with the second connecting module with respect to forces acting onto the first connecting module against the X direction;

the first connecting module is releasable from the second connecting module by tangentially moving the plug-in portion along the spring locking element in the Y direction; and the closure device further comprises a form-fit element protruding along the Y direction from a side surface of the plug-in portion of the at least one of the connecting modules, the form-fit element engaging with a corresponding recess extending along the Y direction within a side surface of a protrusion element protruding from the distal side surface of the other one of the at least one of the connecting modules, after establishing the latching of the first connecting module with the second connecting module, by moving the first connecting module relative to the second connecting module against the Y direction, in order to lock, in addition to the latching arrangement, the first connecting module in the closed position with the second connecting module with respect to forces acting onto the first connecting module against the X direction, wherein the form-fit element establishes a positive connection against the X direction by engaging into the recess; and the first connecting module is to be attached to the second connecting module by an offset in the Y direction, and is to be moved against the Y direction by the offset for bringing the form-fit element in engagement with the corresponding recess.

2. The closure device according to claim 1, wherein each connecting module includes a plug-in portion and at least one spring locking element.

3. The closure device according to claim 1, wherein each connecting module includes a form-fit element and a recess associated to the form-fit element of the other connecting module.

4. The closure device according to claim 1, further comprising magnetic means which, for supporting the transfer of the first connecting module into the closed position, produce a force of magnetic attraction between the first connecting module and the second connecting module.

5. The closure device according to claim 4, wherein the magnetic means are formed by magnets arranged on the connecting modules or by a magnet arranged on the one connecting module and a magnetic armature arranged on the other connecting module.

6. The closure device according to claim 4, wherein the magnetic means are formed to magnetically support the movement of the first connecting module relative to the second connecting module against the Y direction for bringing the form-fit element in engagement with the corresponding recess.

7. The closure device according to claim 1, wherein the Y direction is directed vertical to the X direction.

8. The closure device according to claim 1, wherein the Y direction is directed tangentially to the latching protrusions of the latching arrangement extending transversely to the X direction.

9. The closure device according to claim 1, wherein a main loading direction, in which the first connecting module is subjected to a tensile load with respect to the second connecting module, is directed at a first oblique angle to the X direction and at a second oblique angle to the Y direction.

10. The closure device according to claim 1, further comprising a locking means for securing the engagement of the form-fit element with the recess, wherein the locking means locks the first connecting module with respect to the second connecting module against shifting in the Y direction, as soon as the form-fit element has come in engagement with the recess.

* * * * *